United States Patent [19]

Sheng

[11] 4,100,654

[45] Jul. 18, 1978

[54] MECHANISM FOR GRIPPING HOOPS ENCIRCLING BUILDING STRUCTURES

[75] Inventor: Sheng P. Sheng, Williamstown, W. Va.

[73] Assignee: Marietta Concrete Company, Marietta, Ohio

[21] Appl. No.: 794,528

[22] Filed: May 6, 1977

[51] Int. Cl.[2] ..... E04B 1/32

[52] U.S. Cl. ..... 24/20 R; 52/248

[58] Field of Search ..... 24/20 R, 20 CW, 21, 24/27, 28; 52/224, 248, 712, 713

[56] References Cited

U.S. PATENT DOCUMENTS

| | | | |
|---|---|---|---|
| 1,078,142 | 11/1913 | Hamann | 52/248 |
| 1,305,692 | 6/1919 | Curry | 52/248 |
| 3,377,757 | 4/1968 | Magers | 52/224 |

*Primary Examiner*—Henry S. Jaudon

*Attorney, Agent, or Firm*—Staas & Halsey

[57] ABSTRACT

A mechanism for gripping hoops which encircle a building structure consisting of first and second angles having first legs abutting each other and second legs engaging the building structure, channels that are substantially semi-circular in cross-sectional configuration provided in the first legs defining a substantially circular passageway through which one of the hoops passes and a bolting mechanism for adjustably securing the first legs together to grip the hoop.

7 Claims, 4 Drawing Figures

30
30
66
25
82
64
62
70
80
22
28
72
26
28
76
18
26
58
28
24
14
20
54
26
32
32
56
50
50
60
78
66
68
44
70
74
84
80
48
38
34
42
48
14
42
40
36
46
52

MECHANISM FOR GRIPPING HOOPS ENCIRCLING BUILDING STRUCTURES

BACKGROUND OF THE INVENTION

The present invention relates to concrete stave building structures, and in particular silos, wherein both economy and flexibility is achieved by utilizing the high compressive strength of concrete and the tensile strength of encircling steel hoops. The steel hoops encircle the concrete staves of the silo and after pretensioning function to hold the polygon formed by the stave elements in compression. To accomplish the foregoing encirclement of the concrete stave elements, there is disclosed herein an improved mechanism for gripping the hoops which consists of a plurality of adjoining angles each of which is provided with a substantially semi-circular channel such that when the angles are positioned in abutting relationship, a substantially circular passageway is defined, and an adjustable bolting mechanism permitting the semicircular channels to grip the hoop after pretensioning so as to hold the stave segments of the silo in compression.

DESCRIPTION OF THE PREFERRED EMBODIMENT

Figure 1:
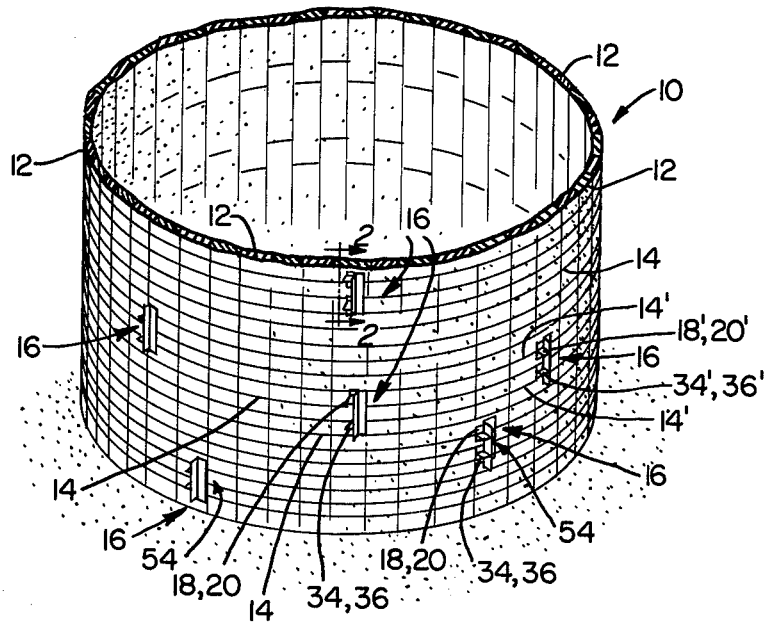
FIG. 1 is a perspective view of a portion of a silo, illustrating the concrete staves of which the wall of the silo is formed, the steel hoops encircling the silo holding the stave elements in compression, and the subject mechanism for gripping the hoops.
Figure 2:
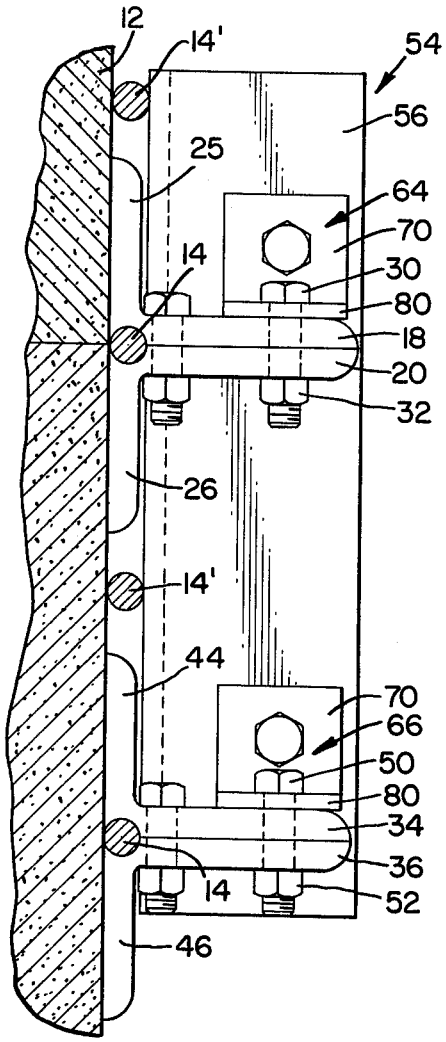
FIG. 2 is a sectional view taken along line 2—2 of FIG. 1, illustrating two of the adjoining angle assemblies defining substantially circular passageways through which two of the hoops pass and additional angle mechanism for joining the aforementioned angles together in a predetermined relationship along the wall of the silo.
Figure 3:
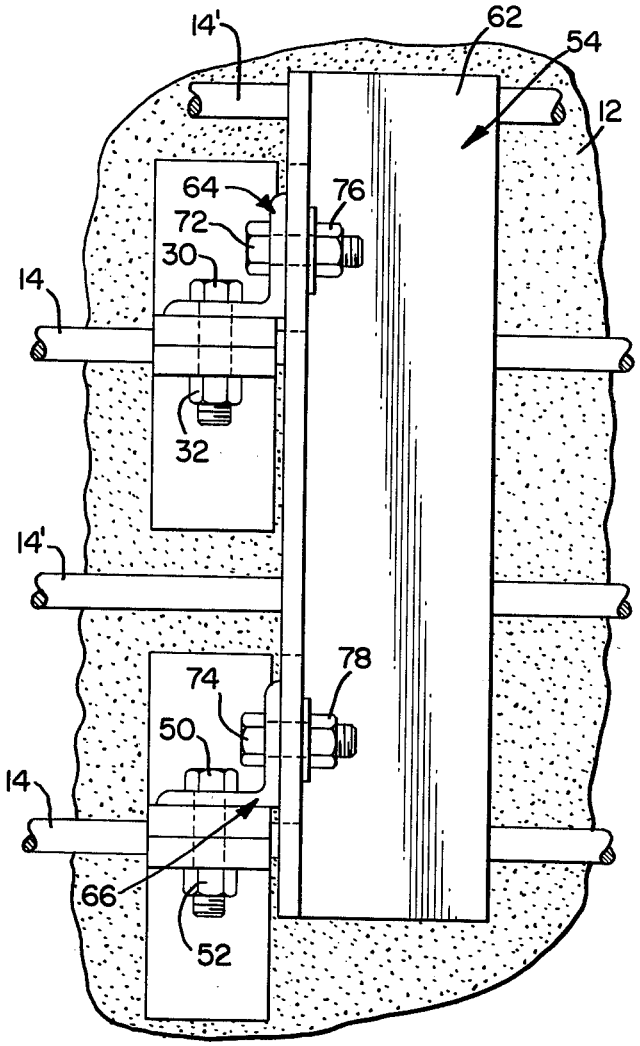
FIG. 3 is a front elevational view of the angle mechanisms illustrated in FIG. 2 positioned in place against a portion of the wall of the silo.

The silo generally designated by the reference numeral 10 in FIG. 1 consists of a plurality of concrete stave segments 12 which are held in compression by the steel hoops 14. The hoop gripping mechanisms generally designated by the reference numeral 16 are disclosed in detail in FIGS. 2–4, as will now be described.

Figure 4:
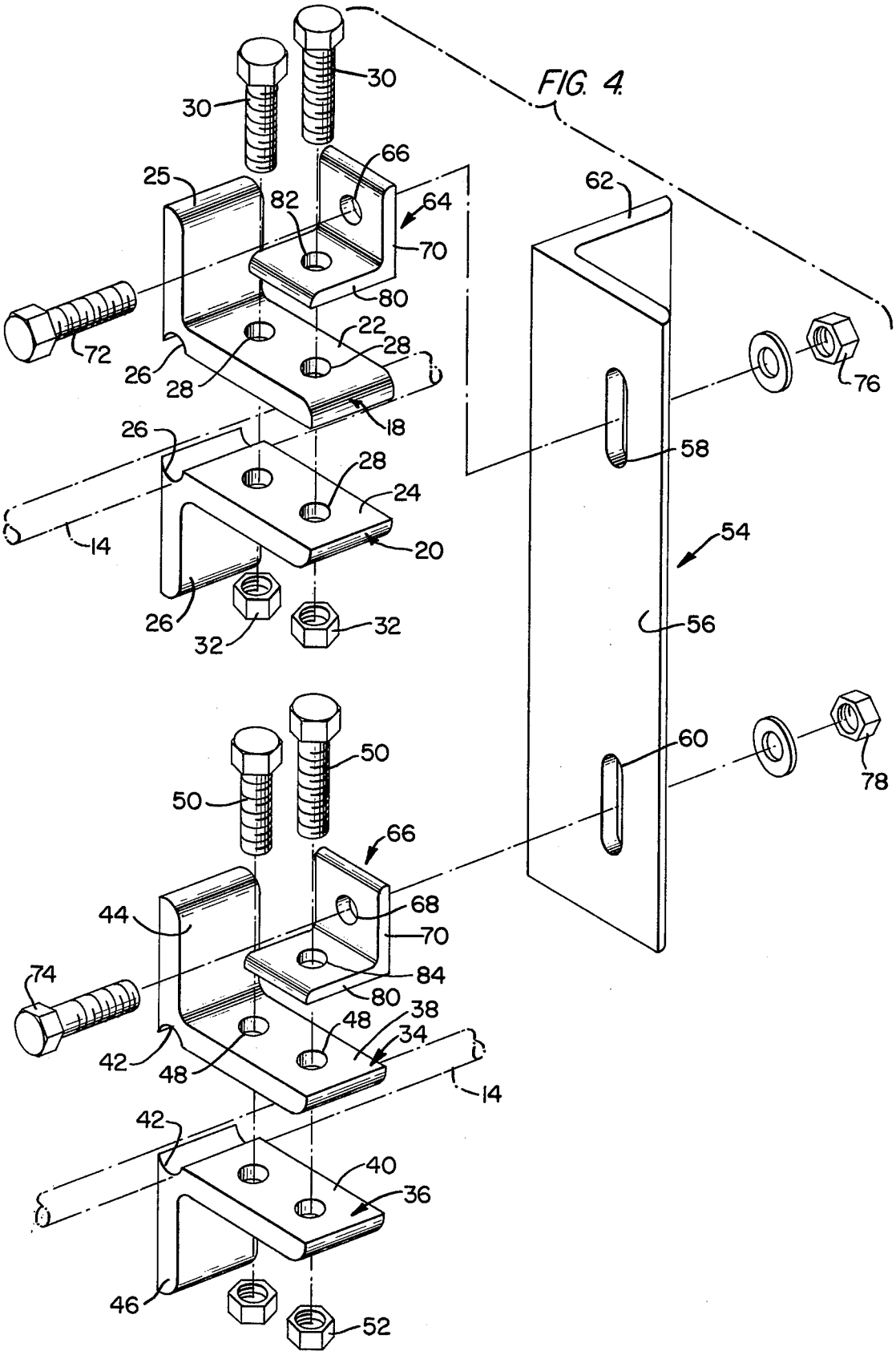
FIG. 4 is an exploded perspective view of the angle mechanisms illustrated in FIGS. 2 and 3.

Each of the hoops 14 is held in place against the stave segments 12 with the use of first and second angles 18 and 20, respectively. With reference to FIG. 4, it will be apparent that the first angle 18 is provided with a first leg 22 which normally rests in abutting relationship against a corresponding first leg 24 of the angle 20. The angles 18 and 20 are also provided with second legs 25 and 26 which normally engage the stave segments 12. Within each of the legs 22 and 24 there is formed a channel 26 which is generally semi-circular in cross-section. The legs 22 and 24 are also provided with openings 28 which accomodate the bolts 30 such that the threading of the nuts 32 on the bolts 30 permits the legs 22 and 24 of the angles 18 and 20 to be secured in abutting relationship against each other, at which time the two semi-circular channels 26 are joined together to define a passageway which is generally circular in cross-section through which the hoop 14 passes.

In like manner, the reference numerals 34 and 36 designate third and fourth angles which include first legs 38 and 40 provided with semi-circular channels 42 and second legs 44 and 46. The legs 38 and 40 are also provided with openings 48 through which the bolts 50 pass such that as the nuts 52 are tightened on the bolts 50 the legs 38 and 40 are brought into abutting relationship, at which time the semi-circular channels 42 define a substantially circular passageway through which another of the hoops 14 passes.

The reference numeral 54 designates a fifth angle which is provided with a first leg 56 having two elongated slots 58 and 60 and a second leg 62.

The sixth and seventh angles designated generally by the reference numerals 64 and 66 connect the assembled angles 18, 20 and 34, 36 to the angle 54 and are provided with openings 66 and 68, respectively, in the first legs 70 thereof which accomodate the bolts 72 and 74. In this manner the bolts 72 and 74 pass through the openings 66 and 68 of the angles 64 and 66 and the slots 58 and 60 of the fifth angle 54, afterwhich the tightening of the bolts 76 and 78 on the screws 72 and 74 causes the legs 70 to be secured in abutting relationship against the leg 56 of the angle 54. In similar manner, the second legs 80 of the angle 64 and 66 are provided with openings 82 and 84 such that one of the bolts 30, 50 may pass through the openings 82, 84 permitting the sixth angle 64 to be secured to the angle 18 and the seventh angle 66 to be secured to the angle 34.

Since the second leg 62 of the fifth angle 54 does not engage the surface of the stave segments 12, it will be apparent that the hoop designated by the reference numeral 14' is free to pass between the leg 62 and the stave segments 12. Thus, the fifth angles 54 may be arranged in a pattern, such as illustrated in FIG. 1, wherein alternating of the hoops 14 after pretensioning are secured by adjacent of the angles 18, 20 and 34, 36 permitting the other alternating hoops 14' to be secured by the angles 18', 20 and 34', 36' of an adjacent angle 54'. Although not comprising a part of the present invention, it is to be understood that the ends of the steel hoops 14, 14' are suitably connected to each other along the surface of the silo 10 by connecting members of suitable construction.

I claim:

1. A mechanism for gripping hoops encircling a structure, comprising:

first and second angles having first legs abutting each other and second legs for engaging the structure;

channels of semi-circular cross-section provided in said first legs defining when said first legs are in abutting relationship a substantially circular passageway through which one of the hoops passes; and means adjustably securing said first legs together.

2. A mechanism as in claim 1, wherein said first and second legs of said angles intersect each other at approximately 90°.

3. A mechanism as in claim 1, wherein said means adjustably securing said first legs together comprises a bolt and nut assembly.

4. A mechanism as in claim 1, further comprising third and fourth angles having first legs abutting each other and second legs for engaging the structure;

channels of semi-circular cross-section provided in said first legs of said third and fourth angles defining when said first legs are in abutting relationship a substantially circular passageway through which another of the hoops passes; and means adjustably securing said first legs of said third and fourth angles together.

5. A mechanism as in claim 4, wherein said first and second legs of said third and fourth angles intersect each other at approximately 90°.

6. A mechanism as in claim 4, wherein said means adjustably securing said first legs of said third and fourth angles together comprises a bolt and nut assembly.

7. A mechanism as in claim 4, further comprising a fifth angle having a first leg provided with two elongated slots therein and a second leg, sixth and seventh angles having first legs resting in abutting relationship against said first leg of said fifth angle in the vicinity of said slots and second legs resting against said first legs of said first and third angles, means adjustably securing said first legs of said sixth and seventh angles to said first leg of said fifth angle through said slots, and wherein said means adjustably securing said first legs of said first and second angles together and said first legs of said third and fourth angles together also secures said second legs of said sixth and seventh angles to said first legs of said first and third angles.

* * * * *